United States Patent [19]

Björnson

[11] 4,029,018

[45] June 14, 1977

[54] SABOT FOR SUBCALIBRE PROJECTILE

[75] Inventor: Björn Ove Björnson, Karlskoga, Sweden

[73] Assignee: AB Bofors, Bofors, Sweden

[22] Filed: Aug. 11, 1975

[21] Appl. No.: 603,900

[30] Foreign Application Priority Data

Aug. 21, 1974 Sweden ..... 7410607

[52] U.S. Cl. ..... 102/93

[51] Int. Cl.[2] ..... F42B 13/16

[58] Field of Search ..... 102/93

[56] References Cited

UNITED STATES PATENTS

| | | | |
|---|---|---|---|
| 2,994,274 | 8/1961 | Dunlap | 102/93 |
| 2,996,010 | 8/1961 | Frantik | 102/93 |
| 3,620,167 | 11/1971 | Romer et al. | 102/93 |

*Primary Examiner*—Verlin R. Pendegrass

*Attorney, Agent, or Firm*—Pollock, VandeSande & Priddy

[57] ABSTRACT

A sabot adapted to be attached to a subcalibre projectile comprises a generally cylindrical tubular member having a plurality of elongated axially-directed slots passing completely through the member in a radial direction with the slots extending from one end of the cylindrical member toward, but terminating short of, the other end of the member to define a plurality of spaced, elongated axially directed segments which are integral with an unslotted portion of the member adjacent its other end. The unslotted portion acts as an obturator, and the dimensions of the unslotted portion and of the segments are so selected that centrifugal and/or airflow forces acting on the segments after the projectile has been fired operate to break the unslotted portion of the sabot into pieces to separate the sabot from the projectile.

4 Claims, 5 Drawing Figures

SABOT FOR SUBCALIBRE PROJECTILE

The present invention relates to a sabot that can be used for a subcalibre projectile. The sabot is of the kind that consists of a member that can be applied to the projectile, and which is intended to encircle at least a part of the projectile.

For ammunition of this kind, there is a pronounced desire to have a sabot which, in addition to its centering and obturating functions, is designed so that various of its dimensions are not critical to proper operation thereby permitting economical manufacture thereof, and also so that it does not interfere with the flight of the exterior ballistic projectile at the time the sabot is separated from the projectile.

The purpose of the present invention is to create a sabot which primarily solves these problems, and the feature that can mainly be considered to be characteristic for the new sabot is that the body of this member is made in one single piece, with a number of parts, particularly four, formed by means of slots made in and extending in the longitudinal direction of the member, and an unslotted portion, and that the unslotted portion is designed to withstand the expulsion forces for the projectile arising in the gun barrel, but is broken off by the centrifugal and/or airflow forces arising in or on, respectively, the parts extending in the longitudinal direction of the member when the projectile exits from the barrel.

In the case of a rotating projectile, the sabot will then be able to leave the projectile, without affecting the exterior ballistic projectile when the parts extending in the longitudinal direction of the member are separated due to the centrifugal forces. The invention can also be used for nonrotating projectiles, where airflow forces, instead of centrifugal forces, strive to separate said parts.

Figure 5:
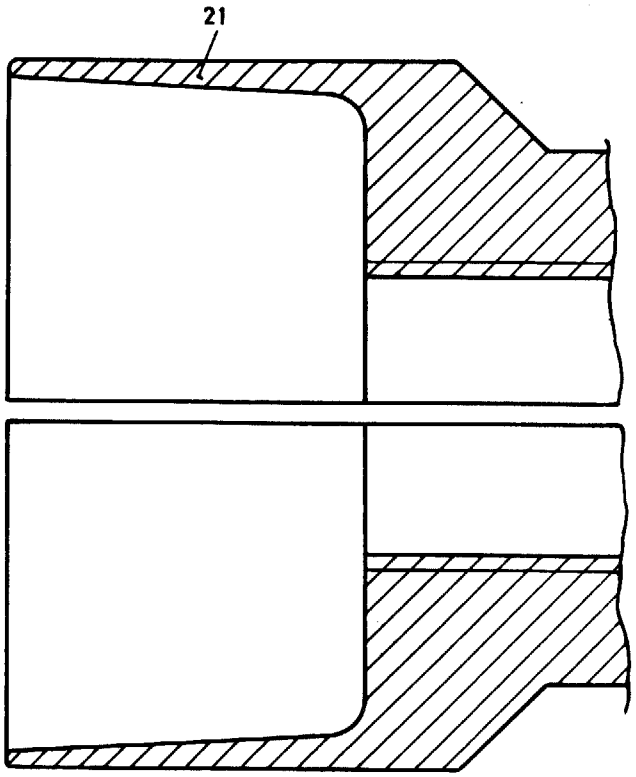

Embodiments proposed at present of a sabot that has the characteristics significant for the invention will be described in the following, with reference to the accompanying drawings, in which FIG. 1 in a vertical view and partly in cross-section shows the sabot applied to a subcalibre projectile, FIG. 2 in a vertical view shows a functioning sketch of the sabot and the projectile according to FIG. 1, FIG. 3 in a vertical view and partly in cross-section shows in detail a first embodiment of the new sabot applied to a projectile partly shown which, in turn, is located in a gun barrel partly shown, FIG. 4 in an end view shows the sabot according to FIG. 3, and FIG. 5 in a vertical view and in cross-section shows the front guide flange of a second embodiment of the sabot intended for a projectile which is not rotation stabilized.

In the figures, parts corresponding to each other have been given the same reference designations.

Figure 1:
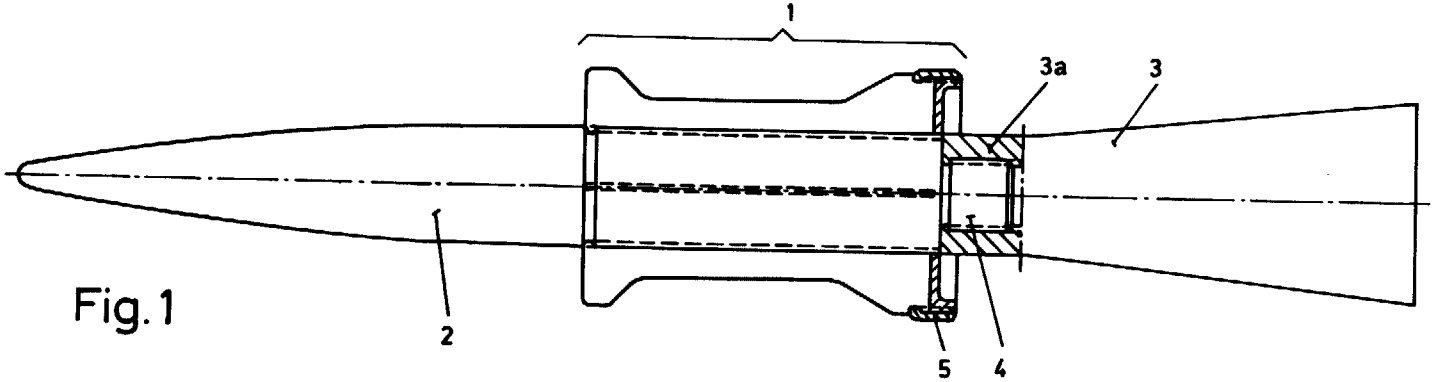

In FIG. 1, a sabot has been given the reference numeral 1. The sabot, which is made in the form of one single unit or member, is applied to a projectile of a kind which is known in itself and which, in principle, comprises a front part 2 and a stabilizing part (flare tail) 3, the front section **3*a* of which can be screwed on to a threaded plug 4 extending rearwards of the front part 2. In accordance with what is described in the following, the sabot 1 is made with internal threads, by means of which it can be screwed on to the front part of the projectile, on external threads on same. At its rear end, the sabot 1 has a driving hand 5, which is secured to the sabot via threads in the driving band and the sabot (see FIG. 3). Said threads have been chosen in such a way that when the projectile rotates in a gun barrel, the driving band 5** will be screwed harder on to the sabot and the sabot will be screwed harder on to the projectile. The sabot is made of steel or a corresponding material.

The sabot is intended to achieve a centering of the subcalibre projectile in the barrel, as well as the necessary obturation between the outer surface of the projectile and the inner surface of the barrel, so that effective expulsion of the projectile will be obtained in the firearm. At the exit from the barrel, the sabot is to be separated from the projectile without disturbing its flight. FIG. 2 is intended to show the separating stage for the sabot, which in the case shown is divided up symmetrically into four parts, two of which have been designated **1*a* and 1*b*. The sabot can, of course, be designed to be divided up into any arbitrary number of parts, e.g. three or four parts. In FIG. 2, the threaded part of the projectile 2, encircled by the sabot shown in FIG. 2, is designated 2*a*. The muzzle of a gun barrel has been symbolized with the numeral 6**.

Figure 3:
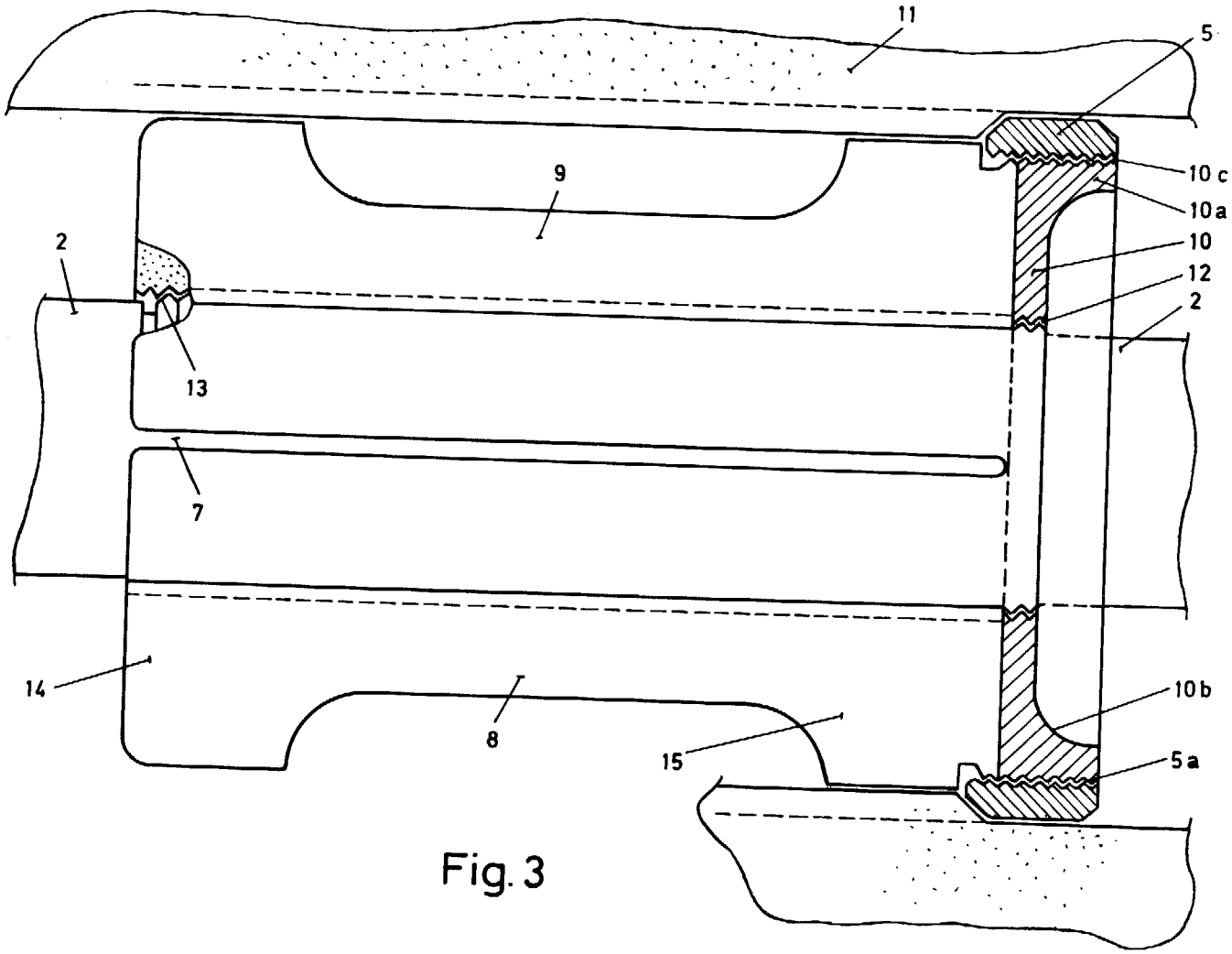

FIG. 3 shows inter alia the sabot in more detail. The body of the sabot is made with a plurality of parts. In the example of the embodiment four parts having been chosen, formed by means of slots 7, extending in the longitudinal direction of the member, of which only two parts, 8 and 9, are shown in the figure. The sabot also comprises an unslotted portion 10. Said slots 7 extend parallel to the center axis of the sabot and rearwards from the front parts of the sabot to the unslotted portion 10, which is thus located farthest to the rear of the sabot. The unslotted portion 10 has been given the form of a ring which, at its periphery, has been extended rearwards with an edge **10*a*, in order to form a surface 10*b* extending rearwards which is substantially concave. On its outer surface, the ring-formed unslotted portion 10 has external threads 10*c* for the driving band 5, which in turn is provided with internal threads 5*a* coacting with the threads 10*c*. The driving band, 5, which can be made of copper or plastic, coacts with the rifling in the barrel in question, which in FIG. 3 has been designated 11. On its inner surface, the unslotted portion 10 has part of the internal threads 12 of the sabot, which coact with the threads 13 on the threaded portion 2*a* of the projectile 2**.

The body of the sabot is made in the form of a hollow cylinder, which has a front guide flange 14 and a rear guide flange 15. The outer surfaces of the guide flanges 14 and 15 are intended to coact with the bore in the barrel 11.

Through the design shown of the sabot, a centering of the projectile in the barrel is obtained, as well as obturation against the expulsion gases developed in the firearm which act upon the surface **10*b***.

Figure 4:
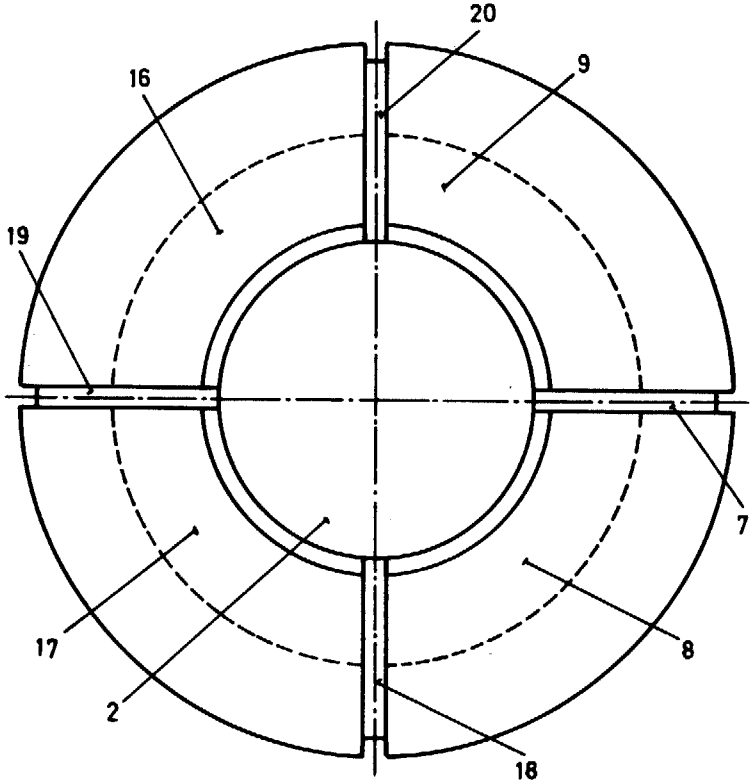

FIG. 4 shows how the body of the sabot is made with four segment-formed parts 8, 9 and 16, 17, by means of four slots 7, 18, 19 and 20, which are thus arranged so that said parts are retained together as a single unit by their being fastened to the unslotted portion 10 shown in FIG. 3.

Figure 2:
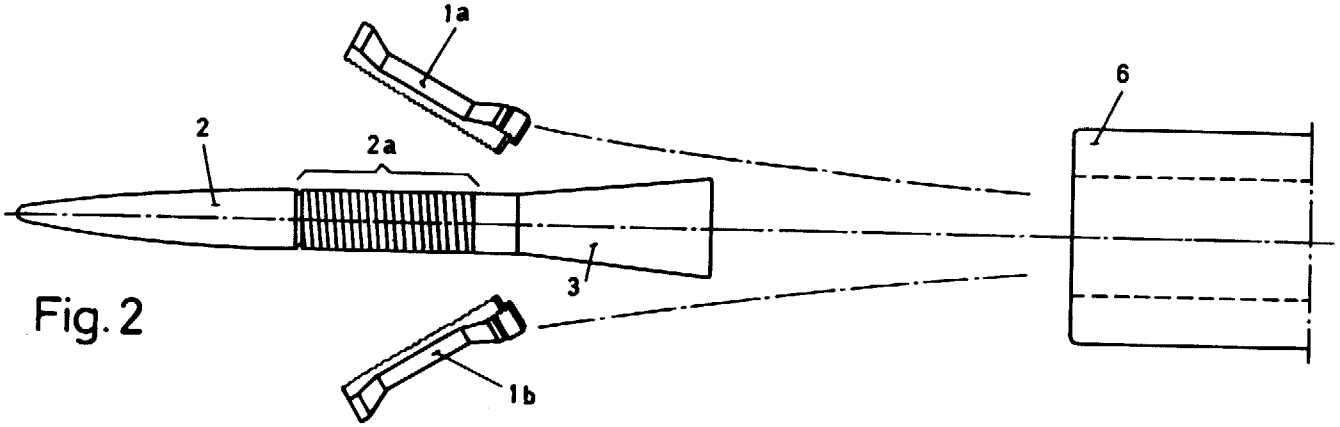

When the projectile and sabot exit from the muzzle of the barrel in the example shown according to FIGS. 3 and 4, great centrifugal forces will act upon the segment-formed parts 8, 9, 16, 17 of the sabot, so that the unslotted portion 10 will be broken up, as shown in FIG. 2.

Practical tests have shown that when a projectile with a diameter of 20 mm has a muzzle velocity of approx. 870 m/s and an original spin of approx. 48,300 r.p.m. it is appropriate to choose the minimum thickness of the unslotted portion (in the longitudinal direction of the sabot) at approx. 1.6 mm (material B9UL-200). The length chosen for the slotted parts is then approx. 60 mm, the slot width approx. 1 mm, and the outer diameter at the body of the member and the length of the body 30 and 40 mm, respectively.

The unslotted portion 10 is thin in relation to the length of the parts 8, 9, 16 and 17. The minimum thickness of the material should be chosen so that it will withstand the powder gas pressure imposed on surface **10*b*** with an appropriate safety factor.

However, said values are not in any way critical to proper functioning of the sabot, and the sabot, for instance as regards the making of the slots, can be manufactured with comparatively wide tolerances, consistent with economical manufacturing.

In case the sabot is to be utilized on a non-rotating subcalibre projectile, it is made with a part 21 (see FIG. 5) extending forwards and around the periphery, so that a cup-formed surface extending forwards is obtained between the part 21 and the envelope surface of the projectile. In the example shown in FIG. 5 the part directed forwards has a length in the direction of the member corresponding to one-third of the remaining length of the member.

The invention is not limited to the embodiments shown above as examples, but can be subject to modifications within the scope of the following claims.

I claim:

1. A unitary device adapted to be attached to a subcalibre projectile for performing the functions of centering the projectile in a gun barrel and obturating said barrel against expulsion gases developed in said barrel at the time of firing to effect propulsion of said projectile from said barrel, and so constructed that said unitary device is fractured into plural pieces by centrifugal and/or airflow forces imposed on said unitary device when said projectile has been fired, said unitary device comprising an elongated generally cylindrical tubular portion adapted to be disposed about said projectile in coaxial relation thereto, said cylindrical portion having a plurality of elongated generally axially directed slots therein disposed in spaced relation to one another, each of said slots extending completely through said cylindrical portion in a radial direction and each of said slots opening into the forwardmost end of said unitary device and extending in an axial direction rearwardly from said forwardmost end to a position closely adjacent, but terminating short of, the rearwardmost end of said unitary device, whereby said slots define therebetween a plurality of spaced, elongated, axially directed segments which have spaced, free ends at said forwardmost end of said unitary device and which segments are integrally joined to one another only at a comparatively thin unslotted portion of said device adjacent its said rearwardmost end, said unslotted portion of said device acting to hold said spaced segments in position relative to one another along said barrel before said projectile is fired, said unslotted portion including an integral, generally axially directed, threaded outer peripheral surface coaxial with and spaced from said projectile, a driving band disposed at the rearwardmost end of said device about said unslotted portion of said device and having an inner threaded surface in thread engagement with said threaded outer peripheral surface of said unslotted portion, said unslotted portion defining, as an integral part thereof, a surface located at the rearwardmost end of said device extending transverse to the axis of said projectile and operative to obturate said barrel when said projectile and said unitary device are inserted into said barrel for firing, the thickness of said unslotted portion in an axial direction being a small fraction of the axial length of said spaced segments whereby centrifugal and/or airflow forces acting on said elongated, spaced segments after said projectile has been fired are operative to effect a pivotal motion of the free ends of said segments about the rearwardmost end of said unitary device to break said unslotted portion of said unitary device into pieces and thereby effect separation of said device from said projectile.

2. The unitary device of claim 1 wherein said integral surface at the rearwardmost end of said device has a substantially concave configuration.

3. The unitary device of claim 1 wherein said device is adapted to be screwed onto a threaded portion of said projectile for attaching said device to said projectile, the surfaces of said axially directed segments which face said projectile being provided with threads which extend from the free ends of said segments at the forwardmost end of said device throughout the length of said segments and continue into the unslotted portion of said device to coact with the threaded portion of said projectile.

4. The unitary device of claim 1 wherein each of said elongated axially directed segments includes a pair of integral, spaced guide flanges extending in a generally radial direction adjacent the opposing ends respectively of said segment, each of said guide flanges defining an integral bearing surface which extends in an axial direction and which is spaced outwardly of the remainder of its associated segment relative to the central axis of said device for direct surface engagement with the bore in said barrel.

* * * * *